US005361923A

United States Patent [19]

Knight, IV et al.

[11] Patent Number: 5,361,923

[45] Date of Patent: Nov. 8, 1994

[54] STACKABLE AND COLLAPSIBLE CONTAINER

[75] Inventors: John W. Knight, IV, New Concord; Paul W. Baker, Cambridge; Dennis Harding, Senecaville, all of Ohio

[73] Assignee: The Fabri-Form Co., Byesville, Ohio

[21] Appl. No.: 119,376

[22] Filed: Sep. 13, 1993

[51] Int. Cl.[5] ..... B32B 27/00

[52] U.S. Cl. ..... 280/6; 220/429; 220/669; 220/666

[58] Field of Search ..... 220/6, 7, 4.32, 669, 220/674, 675, 1.5, 666, 4.28, 4.29; 16/377; 217/12 R, 13, 16, 48, 65

[56] References Cited

U.S. PATENT DOCUMENTS

| | | | |
|---|---|---|---|
| 41,664 | 2/1864 | Hoadley | 16/377 |
| 44,608 | 10/1864 | Crate | 16/377 |
| 431,459 | 7/1890 | Griswold | 16/377 |
| 586,725 | 7/1897 | Ellenbecker | 217/16 |
| 693,981 | 2/1902 | McDonald | 217/12 R |
| 1,092,136 | 4/1914 | Burchess | 16/377 |
| 1,241,844 | 10/1917 | Gottschall | 220/7 |
| 1,673,769 | 6/1928 | Graham | 220/6 |
| 2,525,838 | 10/1950 | Smith et al. | 217/16 |
| 2,625,290 | 1/1953 | Kice et al. | 220/674 |
| 3,246,828 | 4/1966 | Branscum et al. | 220/6 |
| 4,314,649 | 2/1982 | Blomquist | 220/6 |
| 4,643,314 | 2/1987 | Kidd | 217/16 |
| 4,673,087 | 6/1987 | Webb | 206/600 |
| 4,828,132 | 5/1989 | Francis, Jr. et al. | 220/6 |
| 5,174,469 | 12/1992 | Policapelli | 220/674 |

*Primary Examiner*—S. Castellano
*Attorney, Agent, or Firm*—Renner, Kenner Greive Bobak, Taylor & Weber

[57] ABSTRACT

A stackable and collapsible container (10) includes a wall assembly (12) which includes a plurality of opposing panels (20, 21), and hinge means connecting each panel (20, 21) to at least two adjacent panels (20, 21).

8 Claims, 11 Drawing Sheets

STACKABLE AND COLLAPSIBLE CONTAINER

TECHNICAL FIELD

The present invention generally relates to a container, such as may be used for the storage or shipment of goods. More particularly, the invention relates to such a container which may be stacked with other like containers. More specifically, the invention relates to a stackable container, which is also collapsible for ease of storage when not in use.

BACKGROUND ART

In the storage and shipping industry, it is often desirable to provide a container, such as a box, to enclose the goods being handled. Such a container is often used to protect the goods from weather or the like, and also facilitates the handling of the goods. This is especially important in the storage and shipment of bulk goods, such as resins, grains or other granular products.

One type of container includes a cardboard frame which is folded for shipment and which may be opened into the shape of a box. The frame is lined with a plastic bag or sheeting or the like, and a bulk product is placed therein. The bag may be tied closed, and a cover placed over the box. A pallet may be used as a load bearing platform for the frame.

While such cardboard frames are relatively simple to use, they have proven to be deficient for a number of reasons. For example, a cardboard frame has a limited useful life in that it provides little if any weathering protection. Also, such frames are often subject to failure when one or more other such frames are stacked thereon, because cardboard does not always provide sufficient strength for stacking purposes. Because of these drawbacks, cardboard frames have a relatively short service life, after which they are discarded.

When shipping a number of storage containers to a particular location, it is desirable that the containers take up as little room as possible, to save on storage and shipping costs associated therewith. Cardboard frames that can be folded to a relatively flat sheet will accomplish this object, but they still suffer from the drawbacks discussed hereinabove.

A need exists therefore, for a collapsible storage and shipping container. The container should be relatively weather-resistant, and should be strong enough to permit stacking of like containers thereon.

DISCLOSURE OF THE INVENTION

It is therefore an object of the present invention to provide a container for the storage and shipment of materials which is collapsible.

It is another object of the present invention to provide a container, as above, which may be stacked on one or more like containers.

It is an additional object of the present invention to provide a container, as above, which is weather-resistant.

At least one or more of the foregoing objects, together with the advantages thereof over the known art relating to storage and shipping containers, which shall become apparent from the specification which follows, are accomplished by the invention as hereinafter described and claimed.

In general, a stackable and collapsible container comprises a wall assembly including a plurality of opposing panels and hinge means connecting each panel to at least two adjacent panels.

A preferred exemplary stackable and collapsible container incorporating the concepts of the present invention is shown by way of example in the accompanying drawings without attempting to show all the various forms and modifications in which the invention might be embodied. The invention being measured by the appended claims and not by the details of the specification.

PREFERRED EMBODIMENT FOR CARRYING OUT THE INVENTION

Figures 1, 2:
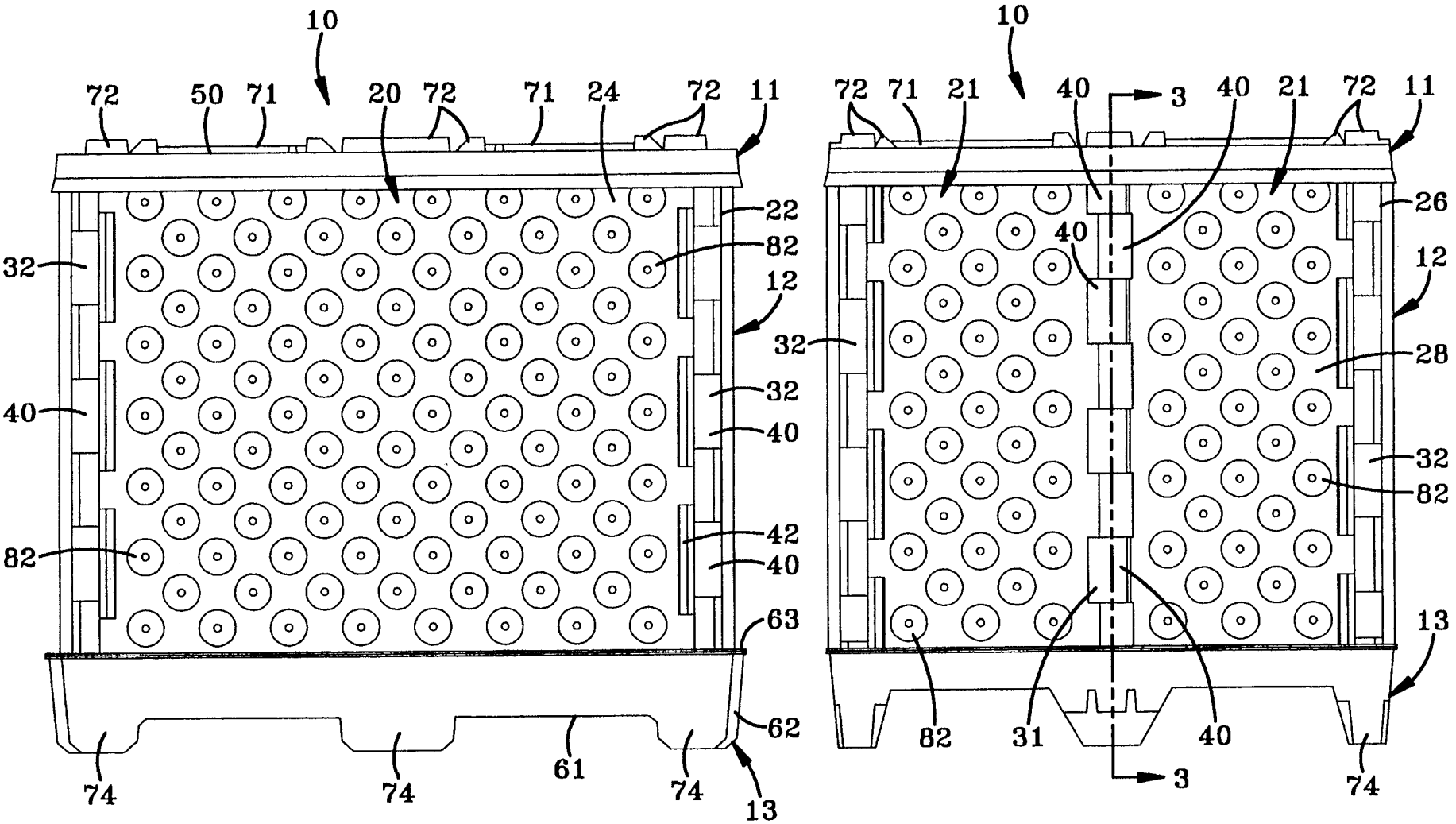
FIG. 1 is a front elevational view of a container embodying the concepts of the present invention.
FIG. 2 is an end elevational view of the container of FIG. 1.

A container according to the concepts of the present invention is generally indicated by the numeral 10 in the drawings. Preferably, container 10 includes a cover 11, a wall assembly 12 and a pallet 13. It is preferred that cover 11, wall assembly 12 and pallet 13 be thermoformed from a polymeric material, such as polyethylene or the like, although various of the components may be made of other materials.

As will be further discussed hereinbelow, wall assembly 12 is collapsible to the position shown in FIG. 4, such that the storage space needed for a number of empty containers 10 is minimized. In the fully extended or non-collapsed position, shown for example, in FIGS. 1, 2 and 9, wall assembly 12 is arranged such that it is placed upon pallet 13, and is closed by cover 11.

Figure 3:
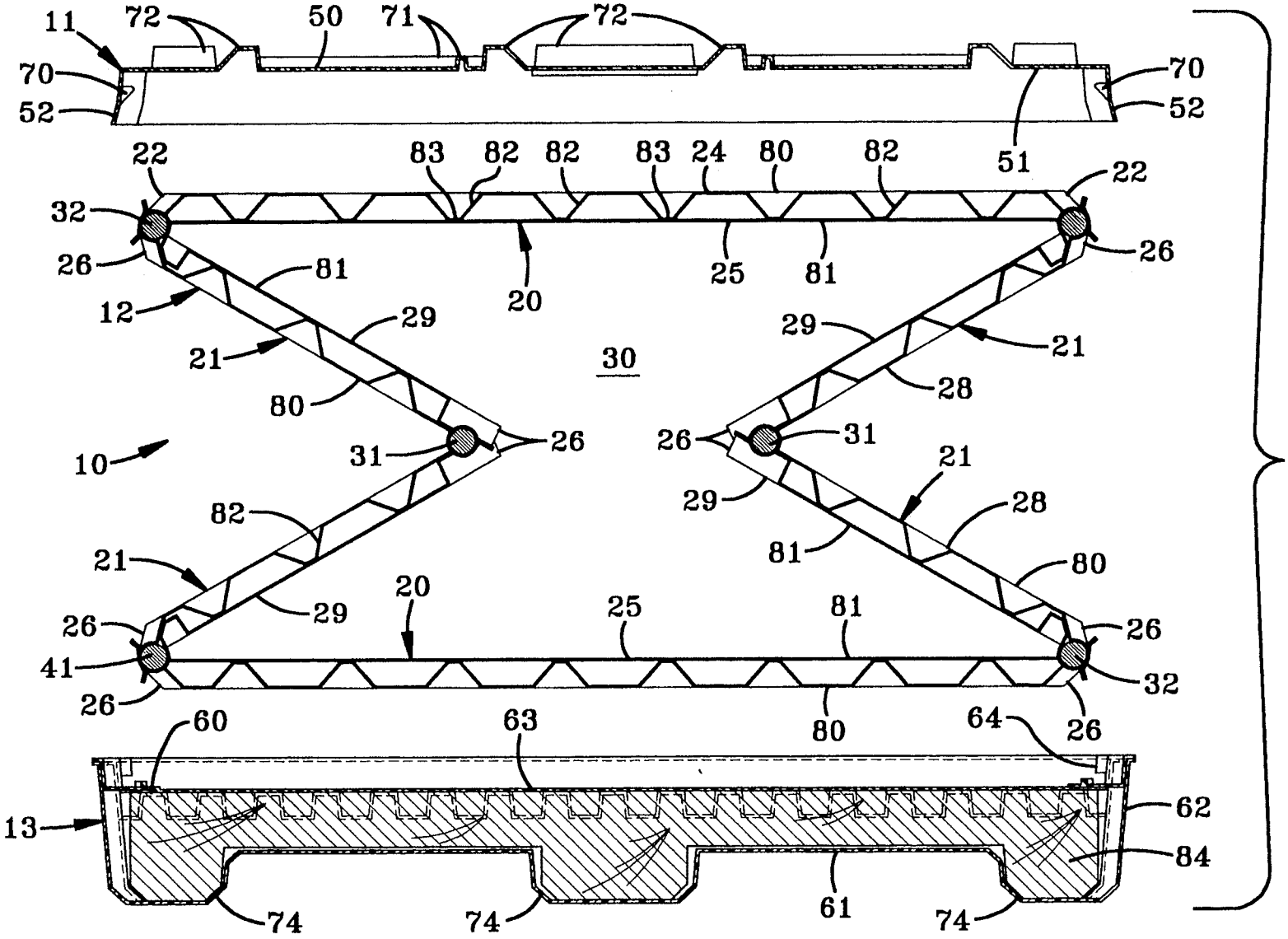
FIG. 3 is an exploded, cross sectional view taken along line 3—3 of FIG. 2, showing a pallet, cover and wall assembly according to the invention, and showing the wall assembly of the container in a partially collapsed position.
Figure 7:
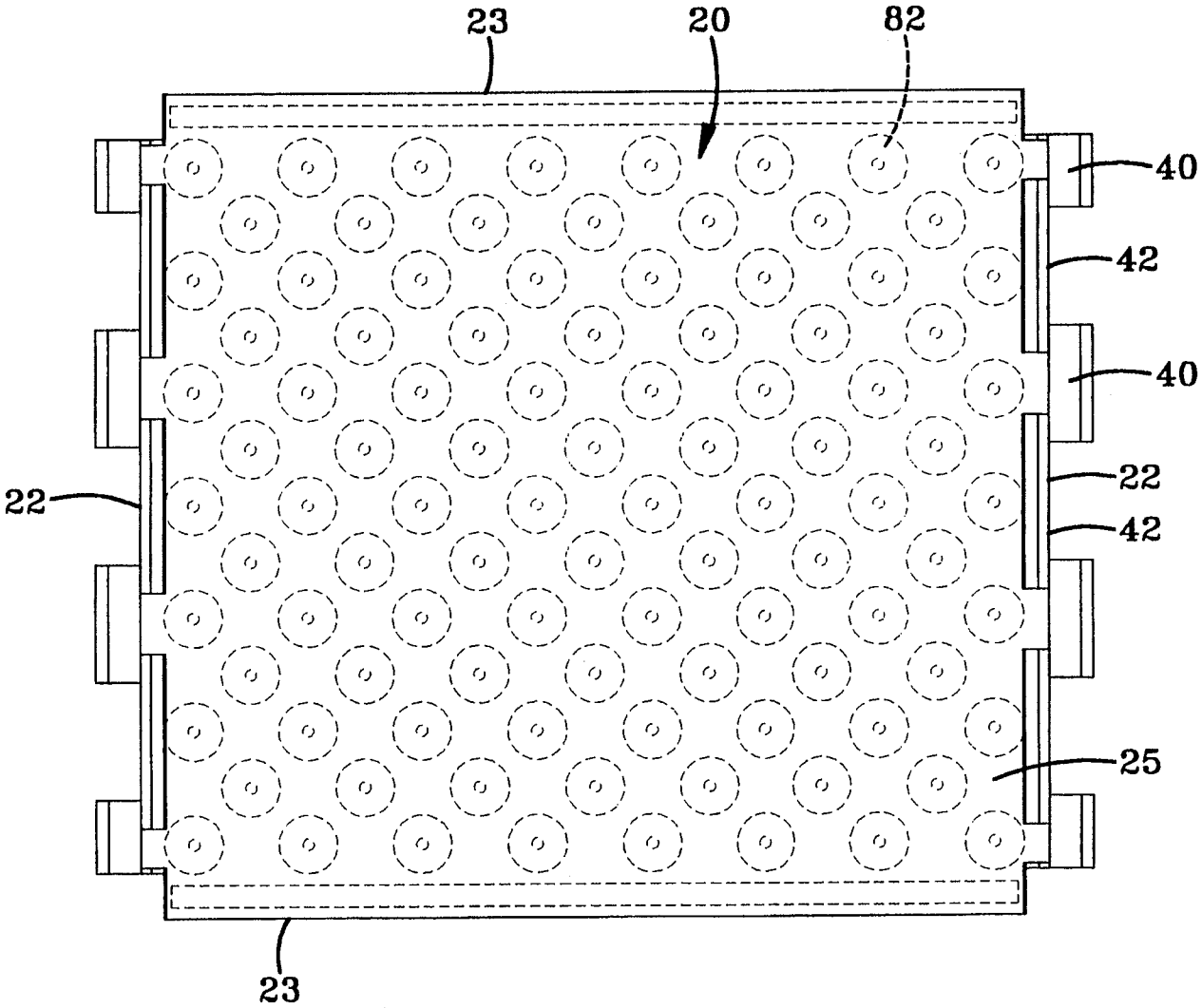
FIG. 7 is a side elevational view of one panel of the wall assembly of FIG. 3.

Wall assembly 12 includes a number of panels including, preferably, long side panels 20 and end panels 21. Preferably, each panel 20 and 21 is generally square or rectangular in shape, as depicted in the drawings. Furthermore, as shown in FIG. 7, each panel 20 includes two opposing hinge sides 22, and two opposing non-hinged sides 23. Panels 20 also have first or outer face portions 24, and second or inner face portions 25 (FIG. 3). Similarly, end panels 21 each have two opposing hinge sides 26, two opposing non-hinge sides 27, and an outer face portion 28 and an inner face portion 29.

Figure 9:
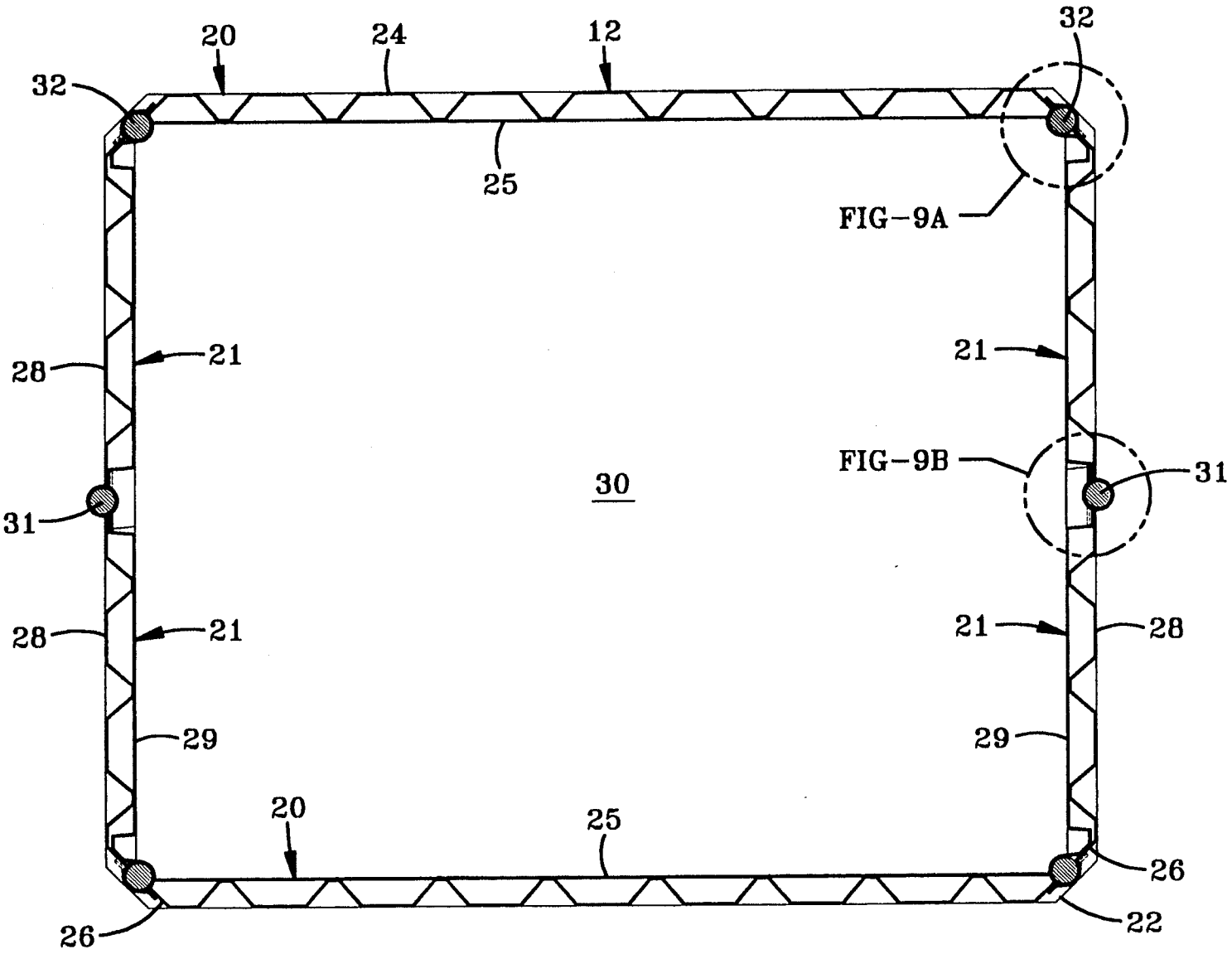
FIG. 9 is a top plan view of the wall assembly of FIG. 3, shown in a fully extended position.

Each long side panel 20 is hingedly affixed at each of its hinge side ends 22 to a hinge side 26 of an end panel 21. Furthermore, each end panel 21 is hingedly affixed at its hinge side 26 opposite that affixed to a long side panel 20, to another end panel 21 at its respective hinge side 26. That is, each long side panel 20 is hingedly affixed to two panels 21 and each end panel 21 is further affixed to another end panel 21, such that the hingedly affixed panels 20 and 21 bound an area therebetween. In FIGS. 3 and 9, for example, the bounded area is generally indicated by the number 30. Outer face portion 24 and 28 of each panel 20 and 21, respectively, faces outwardly from bounded area 30, and inner face portions 26 and 29 face inwardly thereof.

One preferred configuration of wall assembly 12 is depicted in FIG. 9 in the non-collapsed or fully extended position as including two opposing long side panels 20, and four end panels 21. Panels 20, 21 are preferably identical except for the length dimensions thereof. By making long side panels 20 of greater length dimension than end panels 21, a rectangular shaped configuration is achieved when wall assembly 12 is in the fully extended position. Of course, any number of panels 20 and 21, and any other shapes therefor, which will accomplish the objects of the invention, are within the scope thereof.

Figure 9A:
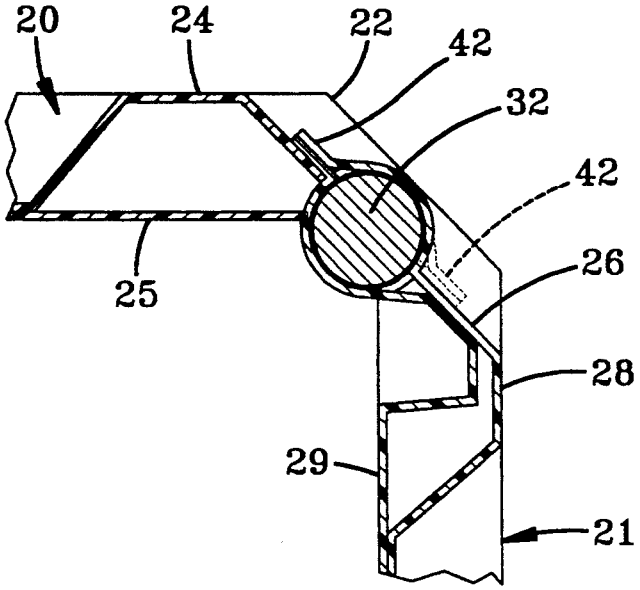
FIG. 9A is a fragmented, enlarged view of one portion of the wall assembly of FIG. 9.
Figure 9B:
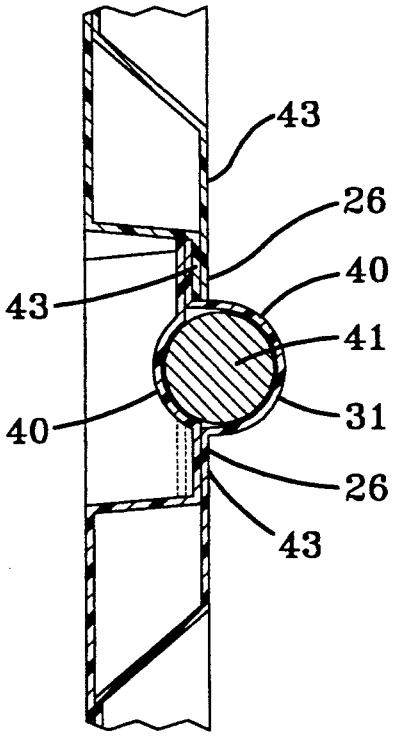
FIG. 9B is a fragmented, enlarged view of another portion of the wall assembly of FIG. 9.

Each end panel 21 is preferably hingedly affixed at one hinge side 26 to another end panel 21 by an intermediate hinge 31 (FIG. 9B). Furthermore, each end panel 21 is hingedly affixed at its other hinge side 26 to hinge side 22 of a long side panel 20 by corner hinges 32 (FIG. 9A). By being hingedly affixed in such a configuration, end panels 21 may be moved relative to each other and to long side panel 20, such that intermediate hinges 31 are movable toward each other, that is, interiorly of wall assembly 12 and within bounded area 30 (FIG. 3).

As shown in FIG. 3, outer face portions 28 of each end panel 21 may be moved toward the outer face portion 28 of the end panel 21 to which the end panel 21 is hingedly affixed, via rotation at the respective hinges 31 and 32. This, in turn, causes inner face portion 25 of each long side panel 20 to also move closer together while remaining in a generally parallel planar position with respect to each other. By causing such movement to continue until outer face portions 28 of hingedly affixed end panels 21 touch or are juxtaposed (FIG. 4), wall assembly 12 is collapsed. Also, in the collapsed position, inner face 25 of each long side panel 20 is juxtaposed to inner face 29 of each end panel 21 to which the long side panel 20 is hingedly affixed.

Hinges 31 and 32 need not be of any particular configuration, and may be any hinge which is conventional in the art and useful for the present purpose. It is preferred, however, that hinges 31 and 32 be integrally formed with panels 20 and 21. Such a preferred hinge, often referred to as a piano hinge will now be described with reference to only hinge 31 for ease of discussion, it being understood that hinge 32 is preferably similarly configured.

Hinge 31 is formed by at least one, and more preferably, a plurality of hinge sleeves 40 integrally formed and regularly spaced on the hinge side 26 of each panel 21 (FIG. 2). Two adjacent and hingedly affixed end panels 21, are arranged such that each hinge sleeve 40 of one end panel 21 is alignable with another hinge sleeve 40 of the adjacent end panel 21 preferably in an alternating fashion from one end panel 21 to the next. A hinge pin 41 (FIG. 9B) is positionable within each sleeve 40, such that when a plurality of sleeves from adjacent panels 21 are aligned, hinge pin 41 is positionable therethrough.

As stated above, hinge 32 is preferably substantially identical to hinge 31. That is, each hinge 32 includes a hinge pin 41 (FIG. 10) positioned through a number of aligned hinge sleeves 40 (FIG. 7) integrally formed in hinge sides 22 of long side panels 20, and hinge sides 26 of end panels 21. However, it is preferred to provide at least one and preferably all of hinge sleeves 40 of each hinge 32 with flanges 42. Flanges 42 are positioned to extend along outer face portion 24 of each panel 20 or outer face 28 of each end panel 21, such that each long side panel 20 is, at a maximum, positionable about ninety degrees from an adjacent end panel 21. Once an end panel 21 is positioned at approximately ninety degrees to a long side panel 20 via rotation at hinges 31 and 32, flanges 42 engage or touch outer face portion 24 or 28, preventing further rotation on hinges 31 and 32 (FIG. 9A). In contrast, for example, because hinges 31 do not have flanges 42, each end panel 21 may be positioned at one hundred eighty degrees from the adjacent end panel 21. As shown in FIG. 9B, non-hinge sides 26 of end panels 21, may be provided with stop surfaces 43, which engage at a certain rotation of adjacent end panels 21, such as at about one hundred eighty degrees as depicted, to prevent further rotation via hinge 31.

When wall assembly 12 is in a non-collapsed, and fully extended position, as shown in FIG. 9, bounded area 30 is generally rectangular in shape. It is preferred that cover 11 and pallet 13 are configured to be slightly larger than the dimensions of the rectangle thus formed, for reasons to be more fully discussed hereinbelow.

Cover 11 is configured with a top surface 50 (FIG. 5), a bottom surface 51 (FIG. 6) and a downwardly extending skirt 52 extending from bottom surface 51 (FIG. 3). Skirt 52 is large enough to fit over the periphery of the fully extended wall assembly 12. Thus, the material contained within wall assembly 12 is protected from damage caused by weathering or the like. Also, when wall assembly 12 is in the fully collapsed position (FIG. 4), long side panel 20 will also fit within skirt 52 of cover 11. In order to assist the user of container 10, skirt 52 of cover 11 may be flared, as at 53, as shown in FIG. 4.

Cover 11 may be provided with a hinge pin restraining collar 54 (FIG. 6), which includes an outer collar portion 55 and an inner collar portion 56. When cover 11 is placed upon fully extended wall assembly 12 (FIG. 2), hinge pin 41 of hinge 31 will be retained within collar 54. Wall assembly 12 is thus prevented from collapsing because hinges 31 cannot move toward each other, as such movement was discussed hereinabove.

Figure 4:
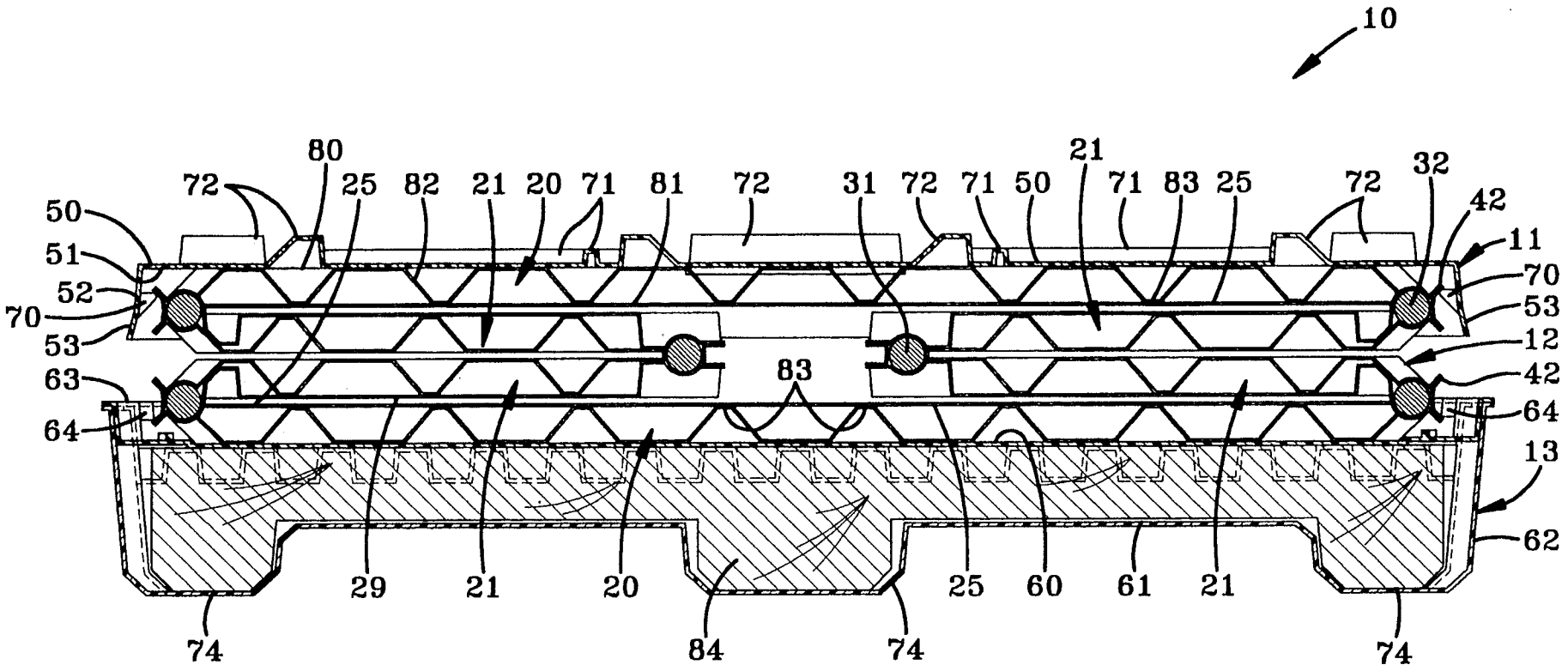
FIG. 4 is a non-exploded, cross sectional view as in FIG. 3, showing the wall assembly in a collapsed position.

Pallet 13 is preferably provided with a top surface 60, a bottom surface 61 and a skirt 62 extending upwardly from top surface 60 (FIG. 4). Skirt 62 of pallet 13 is large enough to encompass the fully extended wall assembly 12, as shown in FIGS. 1 and 2. Also, when wall assembly 12 is in the fully collapsed position (FIG. 4), long side panels 20 will fit within or will be encompassed by skirt 62 of pallet 13.

Figure 5:
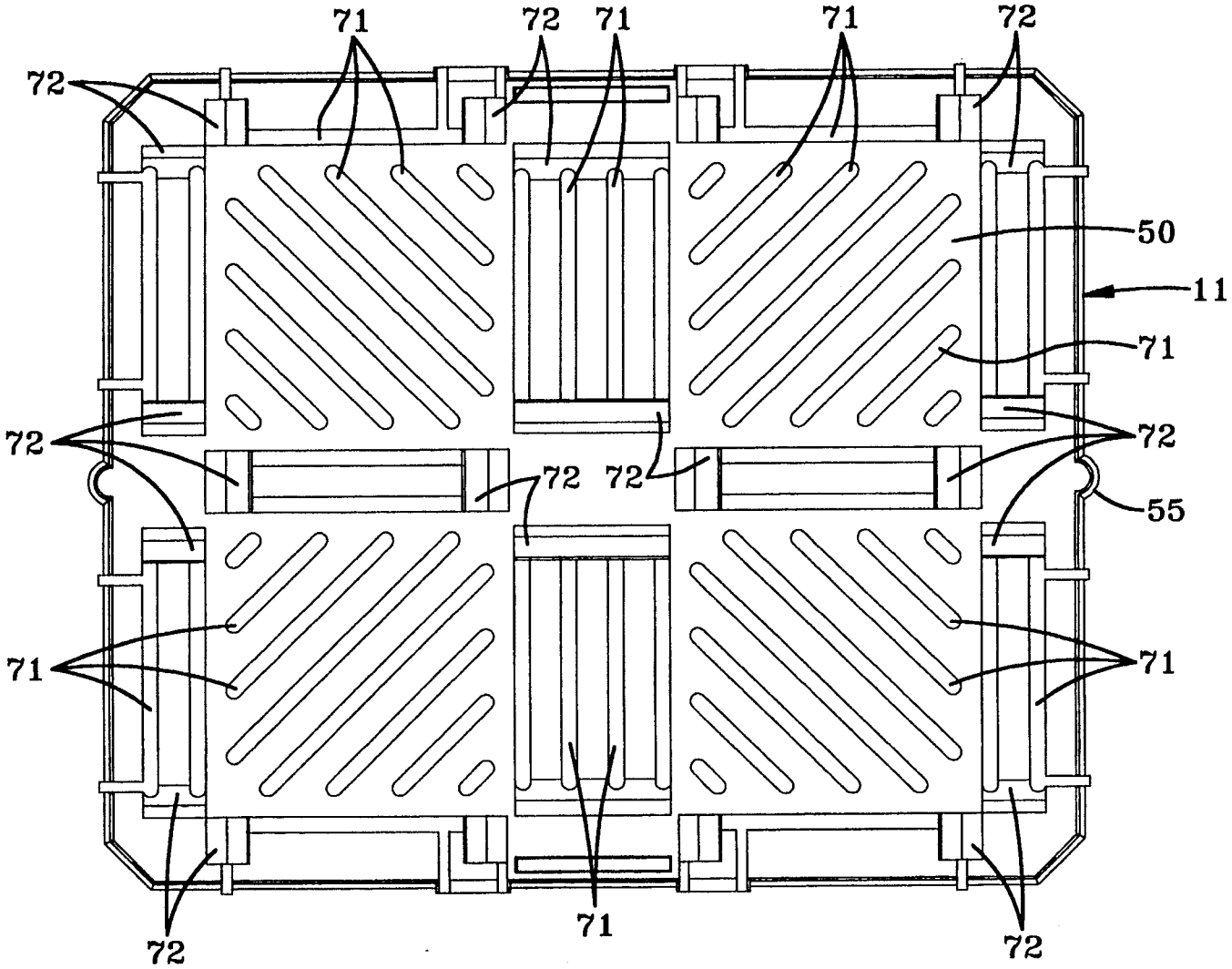
FIG. 5 is a top plan view of the cover of FIG. 3.
Figure 6:
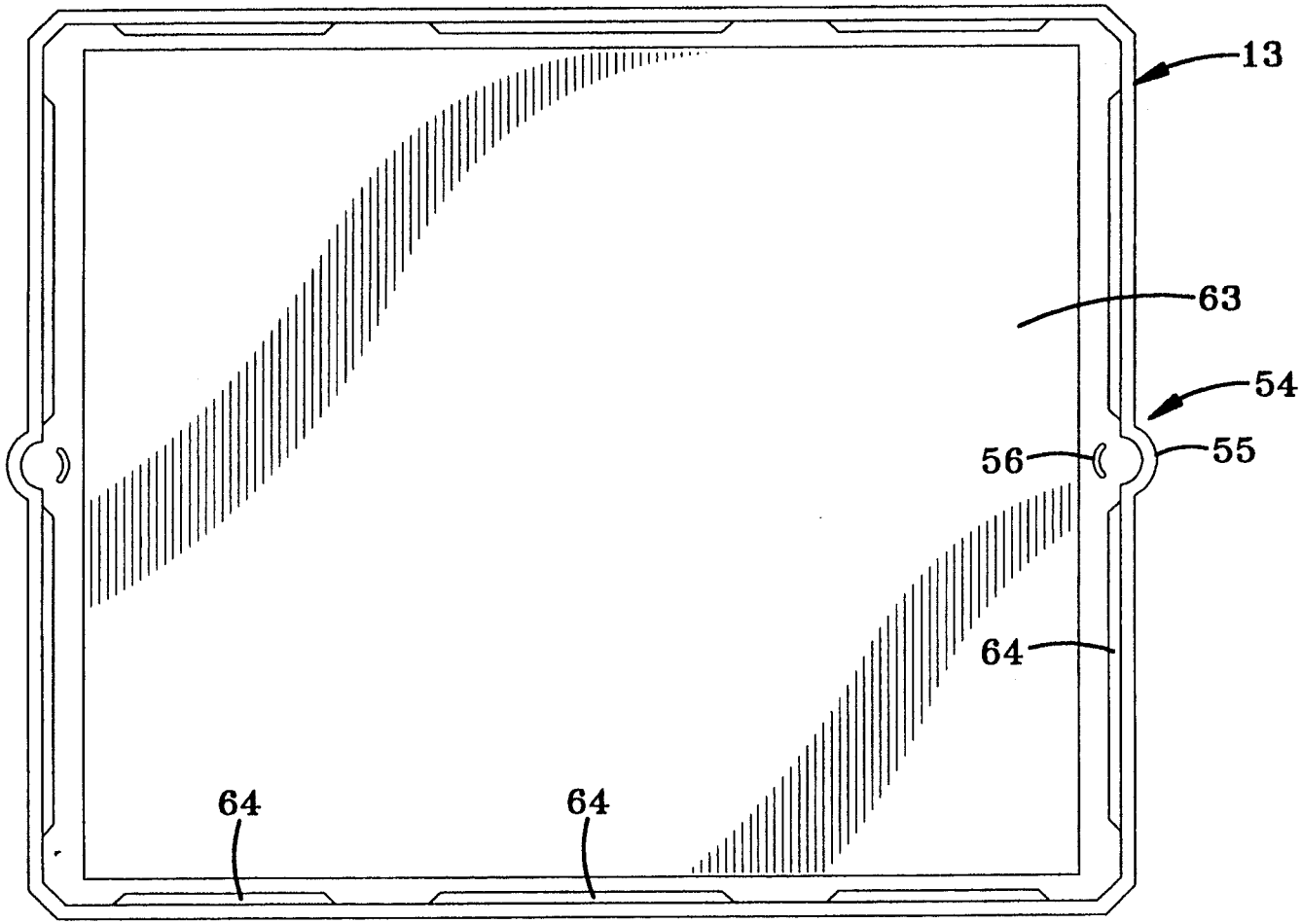
FIG. 6 is a bottom plan view of the cover of FIG. 3.

It is preferred that cover 11 be affixable to wall assembly 12 particularly when container 10 is in the collapsed position. While any such means of affixing is within the scope of the invention, it is preferred that cover 11 be removably affixable to wall assembly 12. To that end a detent or ridge 70 is integrally formed with or affixed upon skirt 52, facing inwardly thereof (FIGS. 4 and 6). Detents 70 are positioned to engage a flange 42 when wall assembly 12 is in the collapsed position and cover 11 is placed thereon (FIG. 4). By making skirt 52 of cover 11 from a relatively thin sheet of polymeric material, skirt 52 can be made relatively flexible. A user may grasp skirt 52, such as at flare 53, and extend skirt 52 away from wall assembly 12. Thus, detent 70 will be caused to be moved away from flare 42, and cover 11 may be removed from wall assembly 12. One exemplary cover 11 includes a plurality of strengthening grooves or ridges 71 (FIG. 5). Also, for reasons to be discussed hereinbelow, cover 11 is preferably provided, in top surface 50 thereof, with a plurality of regularly located positioning blocks 72.

Figure 8:
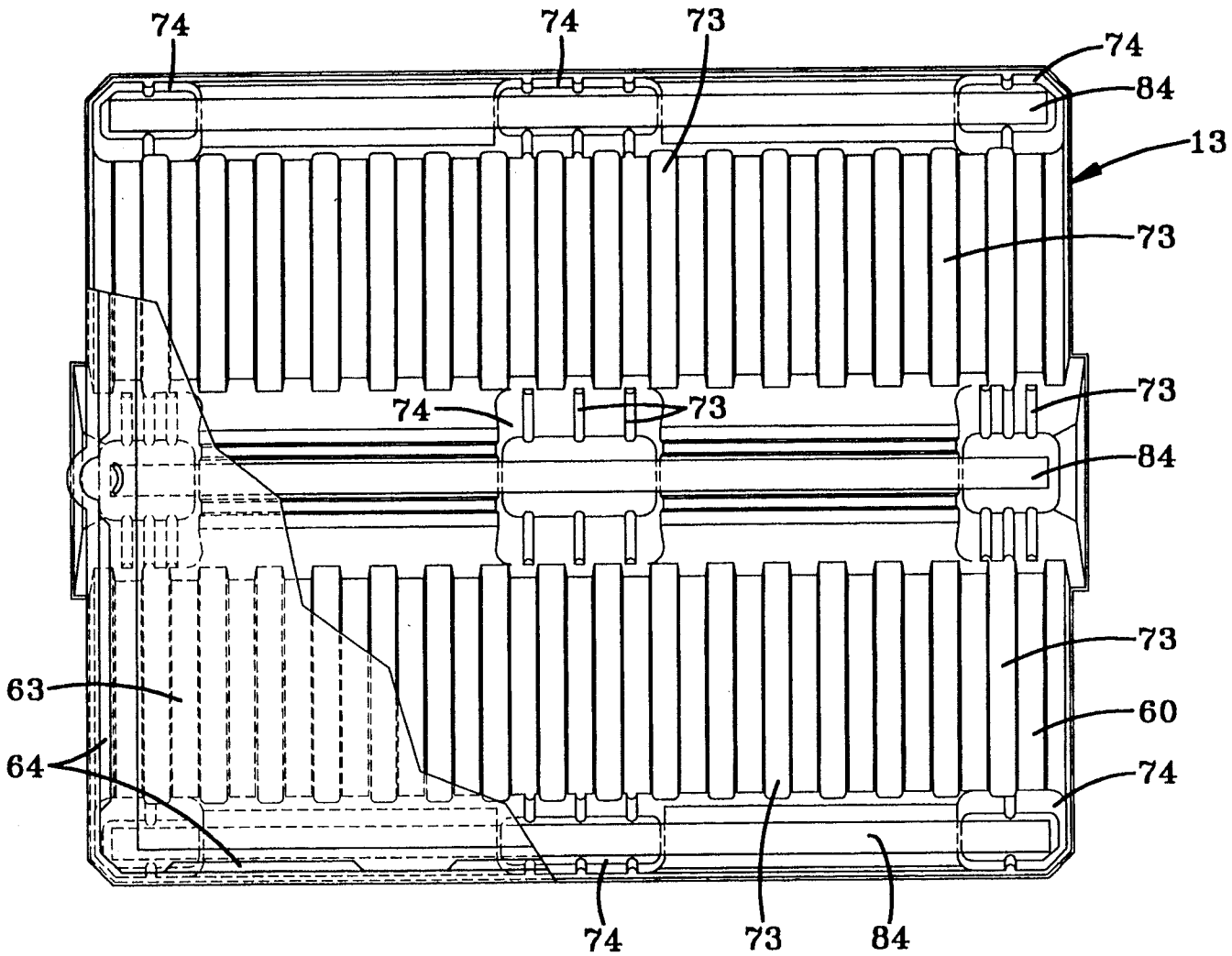
FIG. 8 is a top plan view of the pallet of FIG. 3.

An exemplary pallet 13 is depicted, by way of example, in FIG. 8. Pallet 13 preferably includes a plurality of variably positioned strengthening grooves or ridges 73 of various sizes, and a plurality of downwardly extending feet 74. In the embodiment depicted in the drawings, pallet 13 includes eight feet 74 regularly spaced along the periphery of pallet 13, and one foot 74 centrally located therein.

Figure 10:
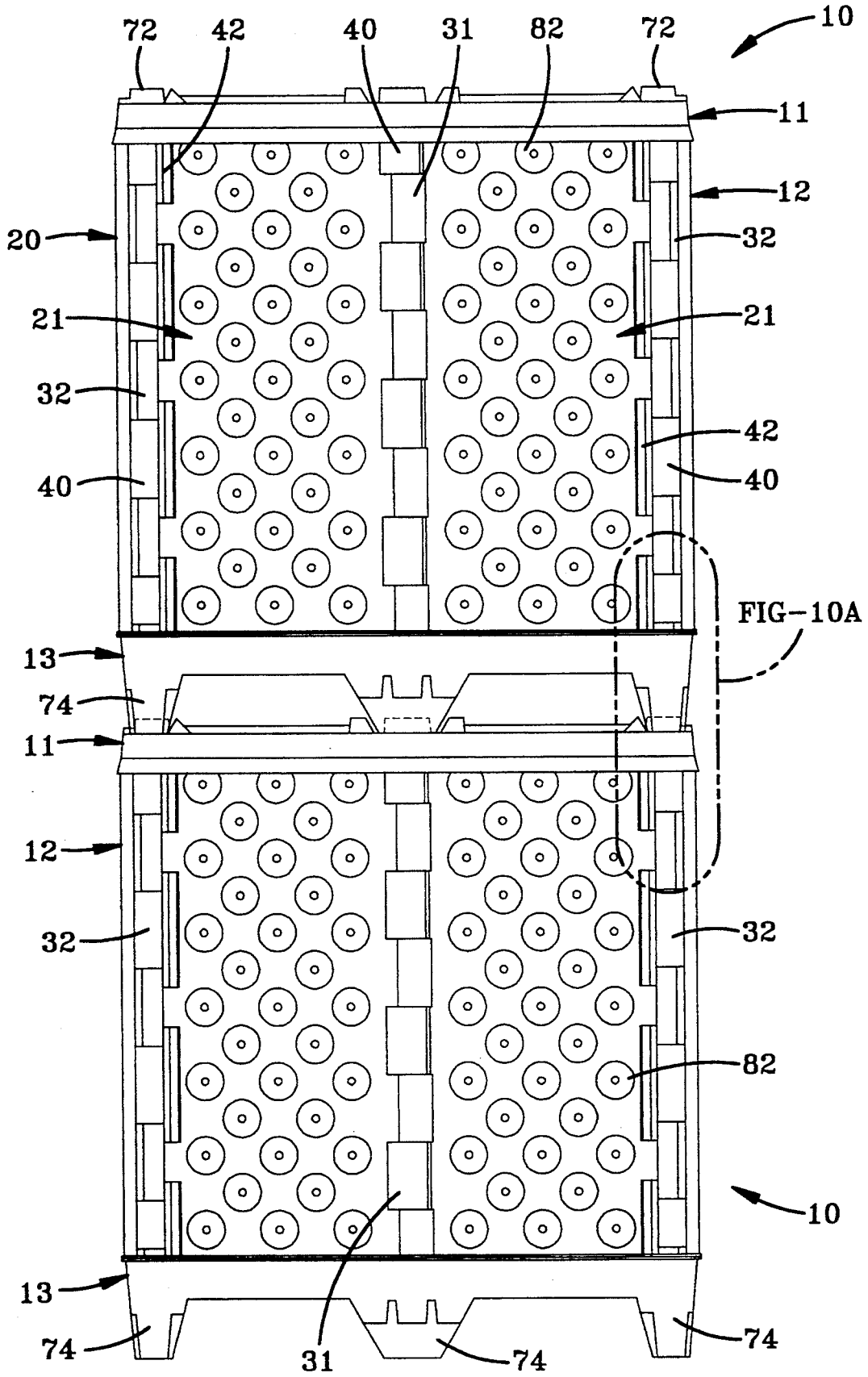
FIG. 10 is a side elevational view of two containers as in FIG. 1, shown one stacked upon the other.

In order to stack one container 10 upon a second container 10, as depicted in FIG. 10, a foot 74 of a pallet 13 stacked above, is positioned onto top surface 50 of cover 11 of container 10 stacked therebelow, preferably between two or more positioning blocks 72. For example, a foot at a corner of pallet 13 may be placed between two positioning blocks 72, while the centrally located foot 74 may be placed between four positioning blocks 72. In this way, as will be appreciated, pallet 13 and wall assembly 12 held within skirt 62 thereof, is prevented from shifting, because feet 74 of pallet 13 will engage positioning blocks 72 of cover 12 of container 10 stacked therebelow.

Hinge pins 41 of corner hinges 32 are flush or extend slightly over non-hinged sides 23 and 27 of each panel 20 and 21, respectively, such that hinge pins 41 engage the bottom surface 51 of cover 11 when two containers 10 are stacked. Also, hinge pins 41 engage feet 74 of pallet 13 stacked thereabove. Thus, when one container 10 is stacked upon a second container 10, the load from the top most container 10 is transferred through feet 74 of its pallet 13, through cover 11 of the container 10 therebelow, through hinge pins 41 of the container 10 therebelow, and through its feet 74 to whatever support surface is below those feet 74. Thus, panels 20 and 21 do not directly bear the load from a container 10 stacked thereon.

In order to provide panels 20 and 21 with structural integrity, it is preferred to fabricate them as a two-ply system. For clarity, the two-ply nature of panels 20 and 21 will be discussed with respect to long side panel 20, it being understood the end panels 21 are preferably of a similar construction. An outer ply 80 forms the outer face portion 24 of a given panel 20, and a separate and spaced inner ply 81 forms the inner face portion 25 thereof (FIG. 3). Extending therebetween are a plurality of spaced protuberances 82, which extend from either inner or outer ply 80 or 81. It is preferred that protuberances 82 extend to, engage and are affixed to the opposite ply 80 or 81.

One type of protuberance 82 which is within the scope of the invention, is a thermoformed depression in outer face portion 24 of each panel 20, as shown in FIG. 1. As shown in FIG. 3, each protuberance 82 is generally in the shape of a truncated cone with a larger diameter base which is open to outer face portion 24, and which tapers to a smaller diameter vertex. It is preferred that the smaller diameter vertex be a bottom wall surface, such as that designated by the numeral 83, which wall surface 83 is bonded, fused during thermoforming, or otherwise affixed to inner face portion 25.

Figure 10A:
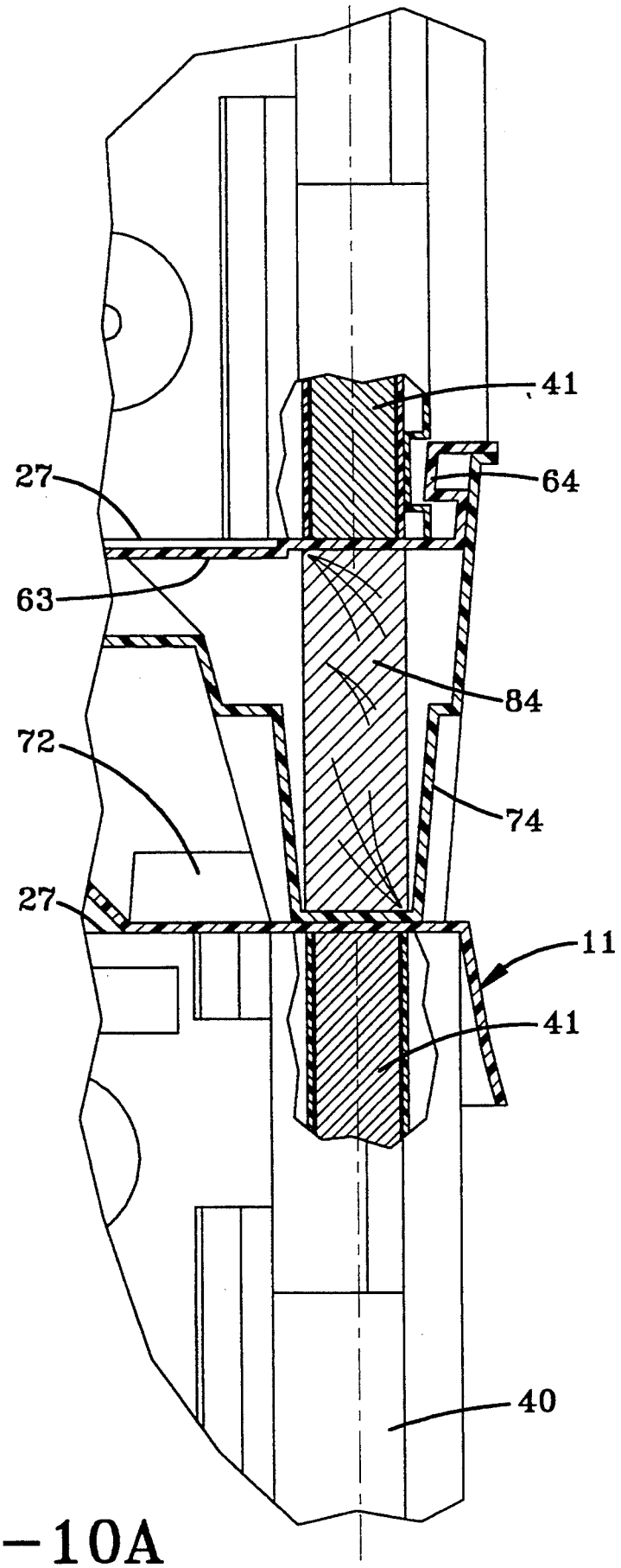
FIG. 10A is a fragmented, enlarged view of one section of the stacked containers of FIG. 10.

When wall assembly 12 is in the fully extended position and is placed upon pallet 13, a material or product (not shown) to be contained may be placed within wall assembly 12 and will rest upon pallet 13. For additional strength, feet 74 of pallet 13 may be provided with a support member, such as a block of wood 84 or the like (FIG. 10A). Cover 11 may then be placed onto wall assembly 12 as discussed hereinabove. If desired, a flexible bag, liner or the like (not shown) may be set within wall assembly 12, such as may be useful for the containment of bulk goods. When not in use, wall assembly 12 is collapsed as discussed hereinabove, and outer face portion 24 of one long side panel 20 is placed upon top surface 60 of pallet 13 and within upwardly extending skirt 62 thereof. Cover 11 is then juxtaposed to outer face portion 24 of the other long side panel 20, and affixed thereto as was discussed hereinabove.

Because container 10 is formed from a polymeric material, it is relatively weather resistant. Furthermore, because most of the load from stacked containers is born by hinge pins 41 and not panels 20 or 21, containers 10 may be stacked without fear of damage to panels 20 or 21.

Thus it should be evident that the present invention provides an effective stackable and collapsible container. The invention is particularly suited for the containment of bulk goods, but is not necessarily limited thereto. The present invention can be used separately with other goods, equipment, methods and the like.

Based upon the foregoing disclosure, it should now be apparent that the use of the container described herein will carry out the objects set forth hereinabove. It is, therefore, to be understood that any variations evident fall within the scope of the claimed invention and thus, the selection of specific component elements can be determined without departing from the spirit of the invention herein disclosed and described. In particular, pallets, covers, locking devices, hinges and the like according to the present invention are not necessarily limited to those discussed hereinabove. As noted hereinabove, other means can be substituted for these elements. Thus, the scope of the invention shall include all modifications and variations that may fall within the scope of the attached claims.

We claim:

1. A stackable and collapsible container, comprising in combination, a pallet and a cover means, said pallet carrying a wall assembly including at least first and second adjacent panels, and hinge means connecting each said first and second panels to each other; wherein said hinge means includes in combination, a hinge pin and a plurality of hinge sleeves, wherein each of said first and second panels are provided with at least one of said hinge such that said at least one hinge sleeve of said first panel is aligned with said at least one hinge sleeve of said second panel, such that said hinge pin is positioned within said aligned hinge sleeves of said adjacent first and second panels defining a collapsed position of said wall assembly when said first and second panels are oriented at an angle of zero degrees to one another; and wherein said at least one said hinge sleeve of said first panel includes an external flange extending therefrom and away from said first panel, such that said flange is engaged with said second panel to limit movement of said first panel on said hinge means in an erected position of said wall assembly; said cover means including a top and a bottom surface and a skirt extending downwardly from said bottom surface; wherein said cover means is removably affixed to said wall assembly by a detent integrally formed in said skirt of said cover means, such that said detent engages said flange when said wall assembly is in the collapsed position.

2. A container as set forth in claim 1, wherein said pallet includes a top surface and a skirt extending upwardly therefrom.

3. A container as set forth in claim 1, wherein said first and second panels each include first and second face portions.

4. A container as set forth in claim 3, wherein each said first and second panels are variably positionable with respect to each other by said hinge means, such that said face portions of said panels are movable to a juxtaposed, relatively parallel planar position.

5. A container as set forth in claim 3, wherein one of said first or second face portions of at least one of said first and second panels includes a plurality of integrally formed protrusions which extend to and engage the other of said first or second face portions of said one panel.

6. A container as set forth in claim 5, wherein each said protrusion of said one face portion of said one panel is affixed to said other of said first or second face portions of said one panel.

7. A container as set forth in claim 1, wherein said wall assembly further includes a third panel hingedly connected to said first panel on a side of said first panel opposite said second panel, and wherein said first panel is a long side panel and said second and third panels are end panels.

8. A first stackable and collapsible container in combination with a second identical container, each container comprising in combination, a pallet having a top and a bottom surface and a cover means, said pallet carrying a wall assembly including at least first and second adjacent panels, and hinge means connecting each said first and second panels to each other; wherein said hinge means includes in combination, a hinge pin and a plurality of hinge sleeves, wherein each of said first and second panels are provided with at least one of said hinge sleeves affixed thereto such that said at least one hinge sleeve of said first panel is aligned with said at least one hinge sleeve of said second panel, such that said hinge pin is positioned within said aligned hinge sleeves of said adjacent first and second panels defining a collapsed position of said wall assembly when said first and second panels are oriented at an angle of zero degrees to one another; and wherein said at least one said hinge sleeve of said first panel includes an external flange extending therefrom and away from said first panel, such that said flange is engaged with said second panel to limit movement of said first panel n said hinge means in an erected position of said wall assembly; said cover means including a top and a bottom surface and a skirt extending downwardly from said bottom surface; wherein said cover means is removably affixed to said wall assembly by a detent integrally formed in said skirt of said cover means, such that said detent engages said flange when said wall assembly is in the collapsed position; wherein said pallet includes a plurality of feet extending downwardly from said bottom surface of said pallet, and said cover means includes a plurality of blocks extending upwardly from said top surface thereof, said feet and said blocks being positioned such that each of said feet of said pallet means of the first container is positionable between at least two of said blocks of said cover means of the second container stacked therebelow.

* * * * *

UNITED STATES PATENT AND TRADEMARK OFFICE

CERTIFICATE OF CORRECTION

PATENT NO. : 5,361,923

DATED : November 8, 1994

INVENTOR(S) : Knight, IV et al.

It is certified that error appears in the above–identified patent and that said Letters Patent is hereby corrected as shown below:

Claim 1, column 6, line 58, insert the phrase "sleeves affixed thereto" between the words "hinge" and "such"

Claim 5, column 8, line 20, "n" should be "on"

Signed and Sealed this

Twenty-sixth Day of March, 1996

*Attest:*

BRUCE LEHMAN

*Attesting Officer*

*Commissioner of Patents and Trademarks*